US008475344B1

(12) United States Patent
Lutz

(10) Patent No.: US 8,475,344 B1
(45) Date of Patent: Jul. 2, 2013

(54) EXERCISE EXTENSIONS AND METHODS

(76) Inventor: Kellan Lutz, Venice, CA (US)

( * ) Notice: Subject to any disclaimer, the term of this patent is extended or adjusted under 35 U.S.C. 154(b) by 0 days.

(21) Appl. No.: 13/566,983

(22) Filed: Aug. 3, 2012

(51) Int. Cl.
*A63B 21/065* (2006.01)

(52) U.S. Cl.
USPC ..... 482/105; 482/44; 482/47; 434/247

(58) Field of Classification Search
USPC ..... 482/44–50, 92, 93, 105–112; 434/247
See application file for complete search history.

(56) References Cited

U.S. PATENT DOCUMENTS

| | | | | |
|---|---|---|---|---|
| 2,017,463 | A | 10/1935 | Komadina | |
| 3,809,397 | A | 5/1974 | Gruenewald | |
| 4,923,418 | A | 5/1990 | Hoffman | |
| 4,998,722 | A * | 3/1991 | Scott | 482/79 |
| 5,062,816 | A | 11/1991 | Berglund et al. | |
| 5,186,699 | A | 2/1993 | Dimmig | |
| 5,378,217 | A | 1/1995 | D'Orta | |
| 5,683,335 | A * | 11/1997 | Groves et al. | 482/105 |
| 6,315,700 | B1 | 11/2001 | Shifferaw | |
| 7,211,032 | B2 | 5/2007 | Shifferaw | |
| 7,537,577 | B2 * | 5/2009 | Phelan et al. | 602/21 |
| 7,892,154 | B1 * | 2/2011 | Alexa | 482/112 |
| 8,348,810 | B2 * | 1/2013 | Land et al. | 482/47 |
| 2004/0087420 | A1 * | 5/2004 | Montesquieux | 482/129 |

FOREIGN PATENT DOCUMENTS

JP 2012-030036 A 2/2012

* cited by examiner

*Primary Examiner* — Glenn Richman
(74) *Attorney, Agent, or Firm* — Cislo & Thomas, LLP; Kelly W. Cunningham, Esq.

(57) ABSTRACT

Exercise devices that can be worn on the hand or foot utilizing resistance from the air to perform the exercises. The exercise device comprises a fitting member and a resistance member connected to the fitting member. The fitting member is configured to be worn on a limb, such as the hand or foot so that the user does not have to hold anything during the exercise. Additional weights can be added to the exercise device, but the overall apparatus remains small and relatively lightweight so that it may be easily carried in luggage and used on the go.

12 Claims, 10 Drawing Sheets

EXERCISE EXTENSIONS AND METHODS

BACKGROUND OF THE INVENTION

1. Field of the Invention

The present invention is in the field of exercise devices that use inertia and/or air resistance to enhance the exercise, and more particularly, such exercises that use flipper-like arm or leg extensions to create such resistance forces.

2. Description of the Related Art

There are numerous exercise devices on the market. Most of them tend to be bulky and expensive because they require a frame or structure in combination with weights, elastic bands, or other resistance mechanisms to provide a resistive force during the exercise routine. Some devices utilize a framework along with only the user's own body weight, but these often are insufficient due to the limited degree to which the user can vary the load or effect of the load for the exercise or accommodate the variety of body weights. These exercise systems likewise tend to be bulky as substantial framework is normally involved. Therefore, there is still a need for an exercise device that provides sufficient resistance, variability, and diversity to perform several exercises and that is light-weight and readily portable.

SUMMARY OF THE INVENTION

The exercise device and method of the present invention comprises one or more flipper or fin-like resistance members attached to fitting members that may be worn, such as on the user's hands, arms, legs, or feet. The user dons the exercise devices and then moves resistance members back and forth in short linear movements such that the air resistance effect of the short linear movements and/or the inertial effect from the changes in the direction of the short linear movements work targeted muscle groups for the exercise.

DESCRIPTION OF THE PREFERRED EMBODIMENTS

Figure 1A:
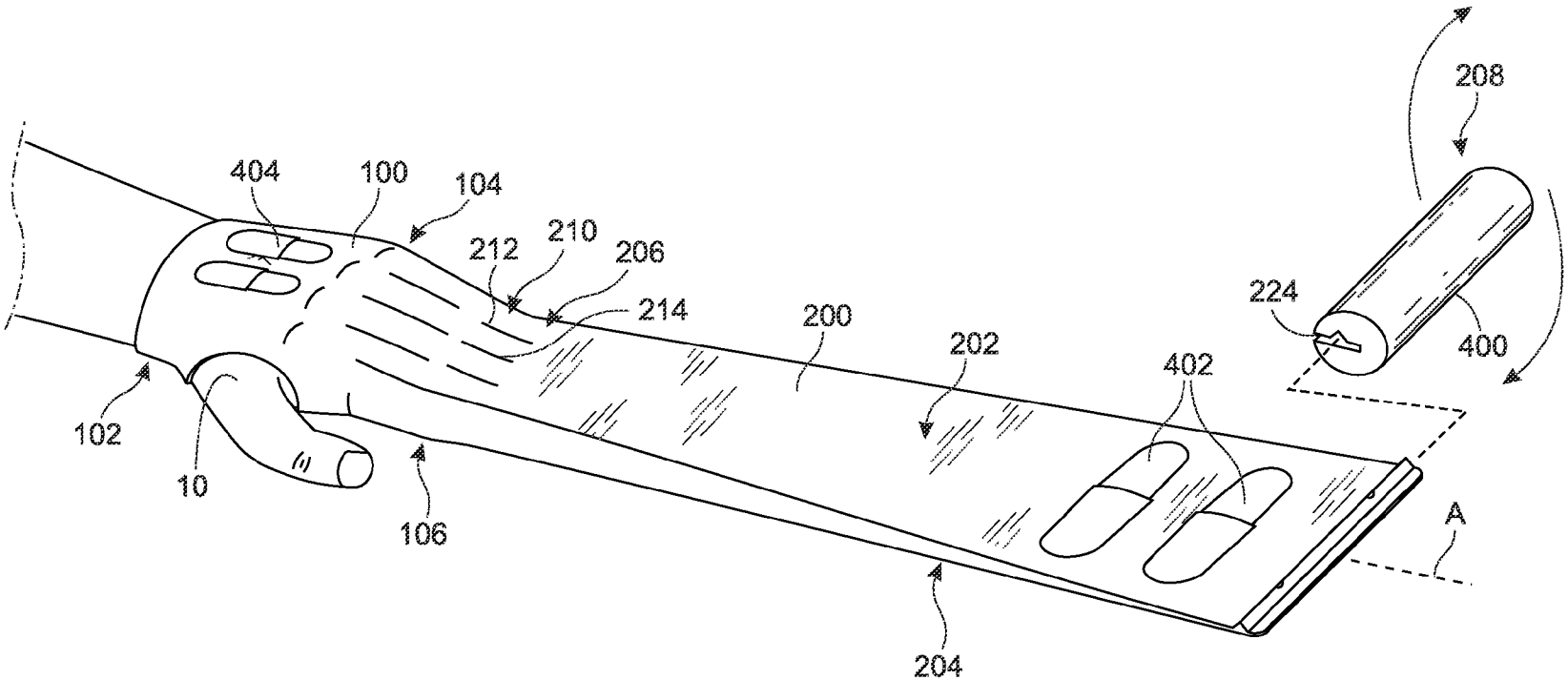
FIG. 1A is a perspective view of one embodiment of the present invention.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

One embodiment of the present invention comprises an exercise device and method for exercising many different muscle groups and comprising one or more resistance members 200 attached to either a hand fitting member 100 or foot fitting member 300. The hand fitting member 100 comprises a proximal portion 102 and a metacarpal portion 104 adjacent to the proximal portion 102. When properly worn, the proximal portion 102 covers some portions of the user's hand, wrist, and/or forearm, and the metacarpal portion 104 covers the metacarpus region of the hand. In some embodiments, the hand fitting members 100 may also comprise a distal portion 106 extending from the metacarpal portion 104 away from the proximal portion 102. When worn properly, the distal portion 106 covers the phalanges, i.e., fingers.

The hand fitting member 100 allows the resistance member 200 to be attached to the hand (or wrist or arm) in one of a number of possible ways so that the user does not have to use his or her fingers to grip the resistance members 200. The hand fitting member 100 configured for the hand may be generally a modified glove in the same way a swim fin is snugly fit to a swimmer's foot. As a result, the user need not hold on to anything in order to perform the exercises. In some embodiments, the hand fitting member 100 may have a single compartment 108 where most of the hand and fingers reside. In other embodiments, each finger or group of fingers is separated into separate compartments. A thumb-hole 110 may be created to free the thumb and allow it to protrude out from the hand fitting member 100.

Figure 3:
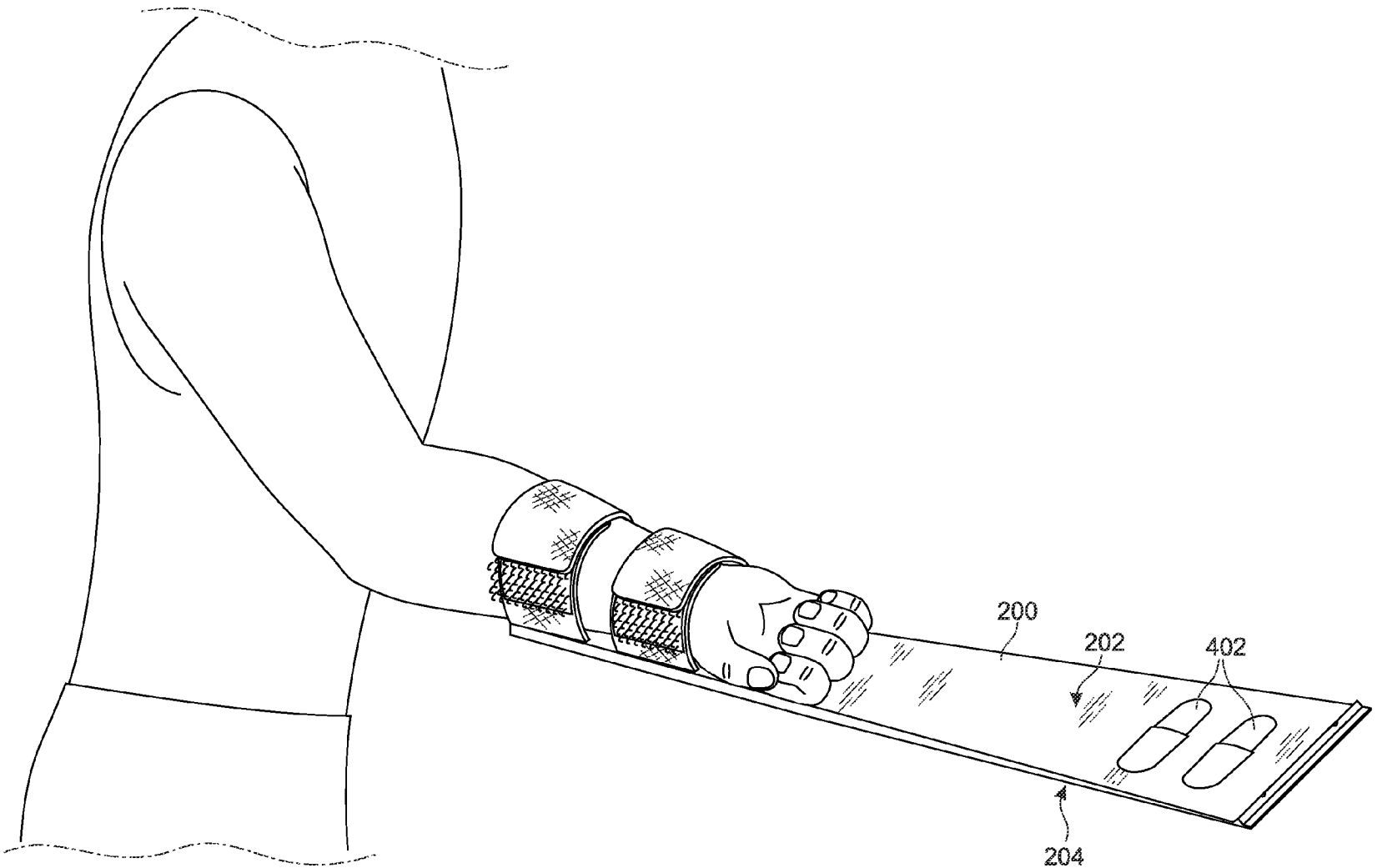
FIG. 3 is a perspective view of another embodiment of the present invention in which the fitting member is designed to attach to the users forearm.

In some embodiments, the hand fitting member 100 may terminate near the wrist area. This will allow the user to perform exercises to strengthen many muscle groups of the body, including although not limited to the upper arms, chest, shoulders, back, and abdominal muscles, as discussed below, but also the user's fingers, wrist, and forearm. In other embodiments, the hand fitting member 100 may extend over at least a portion of the forearm, such as illustrated in FIG. 3. This will allow the user to focus the exercises on the muscle groups such as upper arms, chest, shoulders, back, and abdominal muscles.

In some embodiments, the hand fitting member 100 may be made from a flexible yet durable material. By way of example only, the hand fitting member may be made from, the elastomeric materials used in commercially available swim fins, such as spandex, nylon, neoprene, leather, cotton, and the like. The flexibility of the hand fitting member 100 allows the user to perform exercises to strengthen the fingers and the forearm in addition to the core shoulder, chest, back, and abdominal muscles.

In some embodiments, the hand fitting member 100 may be made from a sturdy and more rigid material. By way of example only, the hand fitting member 100 may be made from plastic, wood, metal, and the like. The rigidity of the hand fitting member 100 may allow the user to focus the exercises to the upper arms, shoulders, back, and chest. It also provides improved durable connection between the hand fitting member 100 and the resistance member 200.

In some embodiments, the hand fitting member 100 may be made from a combination of flexible material and rigid material to provide comfort and flexibility to perform various exercises while also providing stability and durability. In some embodiments, the resistance member 200 may extend up into the hand fitting member 100 to provide additional stability for the connection between the hand fitting member 100 and the resistance member 200.

The foot fitting member 300 is like a piece of footwear modified to be connected to the resistance member 200. Examples of types of footwear that can be modified include, but are not limited to, swim fins, shoes, boots, socks, ankle braces, and the like. Like typical footwear, the foot fitting member 300 has a single compartment 308 into which the foot can be inserted. The compartment is defined by a proximal portion 302 that covers the ankle and a portion of the leg, and a metatarsal portion 304 that covers at least a portion of the bottom of the feet (or metatarsus region), particularly at the arches, and the dorsal portion of the foot and the ankles. Anterior 306 and posterior 307 portions may remain open to allow the toes and heel to be exposed. In some embodiments, the compartment 308 may further be defined by anterior and posterior portions to fully cover the entire foot like a shoe.

In some embodiments, the proximal portion 302 may terminate just above the ankle. This embodiment is useful for exercising the ankles, the legs, the gluteus maximus, the abdominal muscles, and the back, but also the ankles and calf muscles.

The foot fitting member 300, like the hand fitting member 100, may be made from a flexible yet durable material. By way of example only, the foot fitting member 300 may be made from cotton, nylon, leather, spandex, and the like. The flexibility of the foot fitting member 300 allows the user to perform ankle exercises to strengthen the ankles as well as the legs, gluteus maximus, abdominal muscles, and back muscles.

In other embodiments, the foot fitting member 300 may be made from a sturdy and more rigid material. By way of example only, the foot fitting member 300 may be made from metal, plastic, wood, and the like. The rigidity of the foot fitting member 300 allows the user to focus the exercises on the legs, gluteus maximus, abdominal muscles, and back muscles.

In some embodiments, the foot fitting member 300 may be made from a combination of flexible material and rigid material to provide comfort and flexibility to perform various exercises while also providing stability and durability. In some embodiments, the resistance member 200 may extend up into the foot fitting member 300 for a more sturdy connection.

Figure 5:
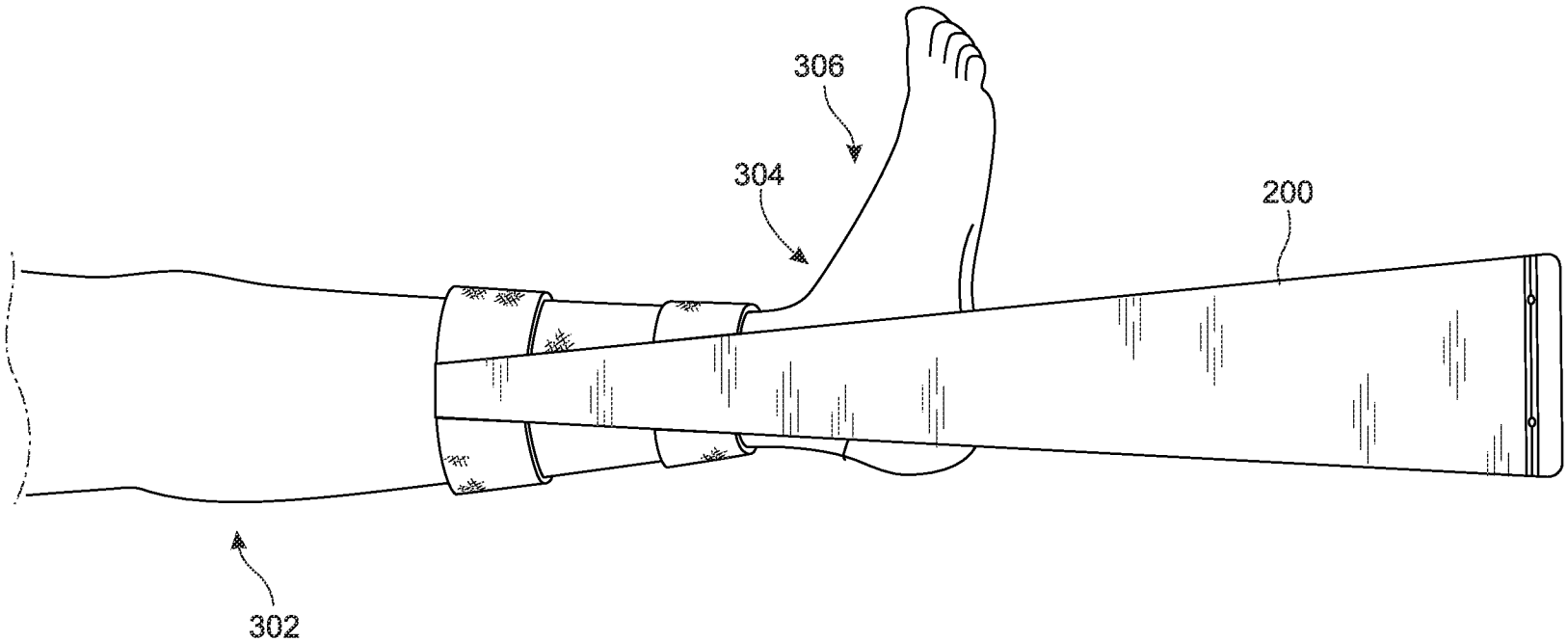
FIG. 5 is a perspective view of another embodiment of the present invention in which the fitting member is designed to attach to the user's lower leg.

As shown in FIG. 5, in other embodiments, the proximal portion 302 may extend up to the lower leg. This embodiment is useful for exercising the upper legs, the gluteus maximus, abdominal muscles, and the back.

Preferably, the resistance member 200 is flat with two surface areas 202, 204 like a fin, flipper, or paddle. The member also may be generally symmetrical about a central axis A, as shown in FIG. 1A. For example, the resistance member 200 may be generally rectangular, quadrilateral, or oval in shape, having a proximal end 206 attached to the fitting members 100 or 300 and a distal end 208 opposite the proximal end 206. The resistance member 200 may be connected to the fitting member 100 or 300 in such a way as to be rotatable about the central axis A, such as shown in FIGS. 2A, 2B, 4A, and 4B. For example, the resistance member 200 may be connected to the fitting member 100 or 300 via a rotatable mount 210. The rotatable mount 210 may have a first member 212 fixed to the fitting member 100 or 300 and a second member 214 fixed to the resistance member 200. The first and second members 212 and 214 may then be coupled in a rotatable fashion.

For example, the rotatable mount 210 may be a ball and socket joint, or two flat surfaces, each having a mating keying member so that the resistance member 200 may be rotated 90° and then temporarily locked at that angle relative to hand or foot fitting member 100, 300. The mount 210 may thus allow the resistance member 200 to be rotated in a graded fashion, such as 45° or through other angles other than just 0° and 90° so that additional exercises and body movements may be achieved. In addition, the mount 210 not only allows the resistance member 200 to rotate about an axis A, but may also to move in two dimensions relative to the fitting member 100 or 300. In other words, besides a rotational movement about a longitudinal axis A defined by the fitting member 100 or 300, the resistance member 200 may also be moved side-to-side or up-and-down relative to the longitudinal axis A of the fitting member.

In another embodiment, the first and second members 212, 214 may have mating surfaces 216, 218 in which the two members 212, 214 can rotate relative to each other along their mating surfaces 216, 218. One of the members 212 may have one or more stops 220 or detents projecting out from or adjacent to its mating surface 216 with each stop 220 angularly spaced apart from another around a circular periphery, whereas the other mating surface 218 may have a plurality of reciprocal notches 222 on or adjacent to its mating surface 218 with each notch 222 angularly spaced apart from another around a circular periphery in such a way that each protruding stop 220 can be seated in one of the notches 222 simultaneously. In some embodiments, a tension device (not shown) may be placed at the centers of the mating surfaces 216, 218 to bias the mating surfaces 216, 218 together. Rotation of the one of the members 216 or 218, either in a clockwise or counter-clockwise fashion, causes each of the protruding stops 220 to dislodge from their respective notch 222 and proceed to slide along the mating face 216 or 218 containing the notches 222 until the protruding stops 220 are seated into their respective adjacent notches 222.

In some embodiments, each stop/notch pair 220, 222 may be spaced apart along a circular perimeter approximately 90° from another stop/notch pair. For example, in one embodiment, there may be two stop/notch pairs 220, 222 or four stop/notch pairs, each pair spaced apart on a circular perimeter approximately 90° apart. This allows the resistance member 200 to have at least two orientations. To illustrate, if a user is wearing the exercise device on his hands with his arms stretched out in front of him with his palms facing each other, the fin-like resistance members 200 extending out from the fitting members 100 or 300 may have their respective flat surfaces 204 of the fin-like resistance members 200 facing each other, thereby assuming a vertical orientation. Waving the user's hands in short back and forth movements, like a clapping action, would create the inertial and air resistance for the exercise. When one member 218 of the mounting device 210 is rotated 90° on each resistance member 200, the flat surfaces 202, 204 will be facing up or down, thereby assuming a horizontal orientation. Now, an up-and-down motion would create the inertial and air resistance for an exercise. In this orientation, a clipping-like, back and forth motion would likewise create the inertial resistance but much less air resistance.

In some embodiments, the stop/notch pairs 220, 222 may be angularly spaced apart from each other by less than 90°. This will permit more than two orientations for the resistance member so that air resistance can be created by movements in more than just an up-and-down or side-to-side motion to increase the range movements, and concomitantly the range of muscle groups affected, that can be attained for an increased variety of exercises.

Figure 1B:
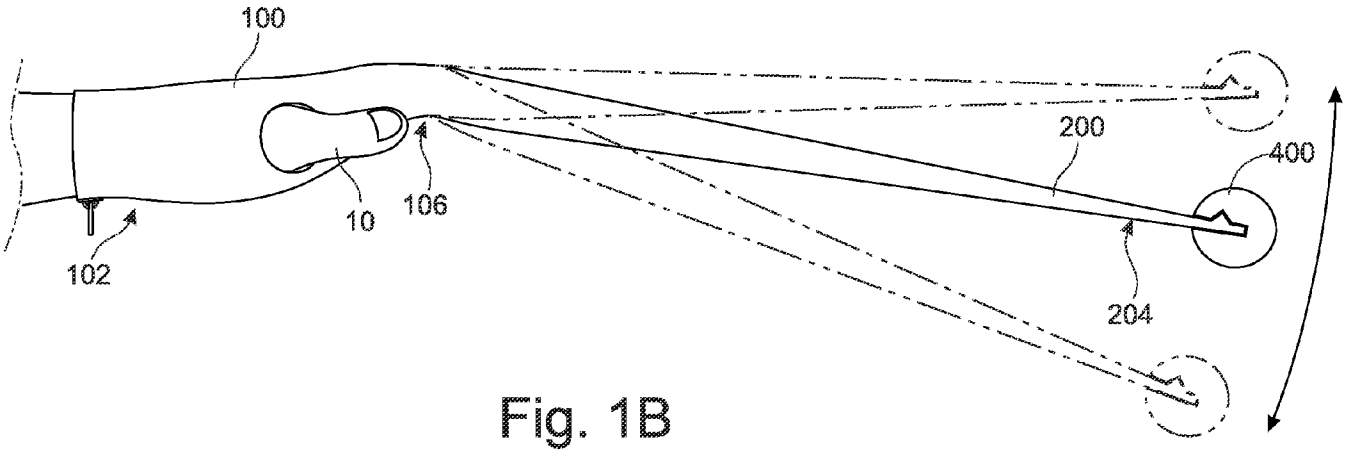
FIG. 1B is a side view of the embodiment of FIG. 1 in which the user is moving the resistance member back and forth in short vertical linear movements.
Figure 1C:
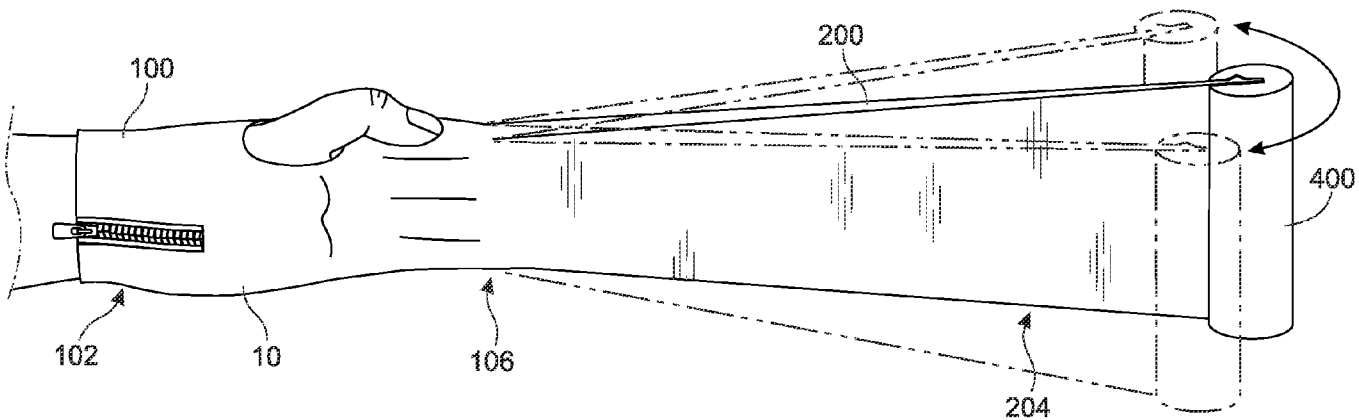
FIG. 1C is a front view of the embodiment of FIG. 1 in which the user is moving the resistance member back and forth in short horizontal linear movements.

In some embodiments, the resistance member 200 may be integrally formed with a fitting member. In such an embodiment, at least for the exercise device for the hand, as shown in FIGS. 1A to 1C, in order to change the motion that creates the air resistance, the user may simply rotate his hands. Additional straps 230 may be provided to increase the stability of the resistance member 200 on the fitting member 100 or 300.

The resistance member 200 may be connected to the fitting member either at the base portion 104 or the distal portion 106. Preferably, for the hand fitting member 100, the resistance member 200 is attached at the distal portion 106. For the foot fitting member 300, the resistance member 200 may be attached to the metatarsal region 304.

In some embodiments, the resistance member 200 may be removably attached to the fitting member 100 or 300. This allows the user to remove one resistance member 200 and put on another resistance member. This may be useful if a resistance member 200 or a fitting member 100 or 300 is damaged and only one of the two needs to be replaced. This is also useful if the user wants to increase the resistance created by the resistance member 200 or try out fins or flippers of different shapes or materials. Thus, the resistance member 200 may come in a variety of shapes and sizes creating different levels of resistance. By way of example only, the resistance member 200 may be rectangular in shape with the short side attached to the fitting member 100 or 300 and the long sides extending away from the fitting member 100 or 300. To increase the resistance, another resistance member may have dimensions (length and/or width) that are greater than the first resistance member. The increased dimensions may also increase the weight and distribute the weight differently depending on a number of factors, including dimensions and thickness. Therefore, the weight of the resistance member 200 can also be controlled by changing a number of factors.

Figure 2A:
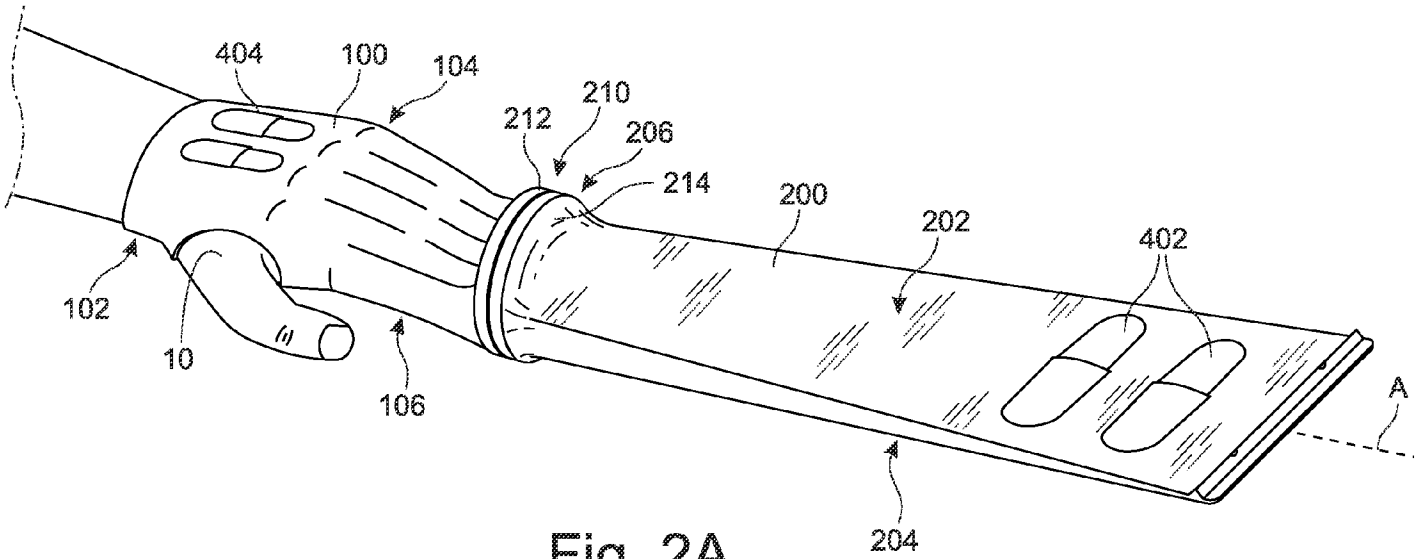
FIG. 2A is a perspective view of another embodiment of the present invention in which the resistance member is rotatably attached to a hand fitting member.
Figure 2B:
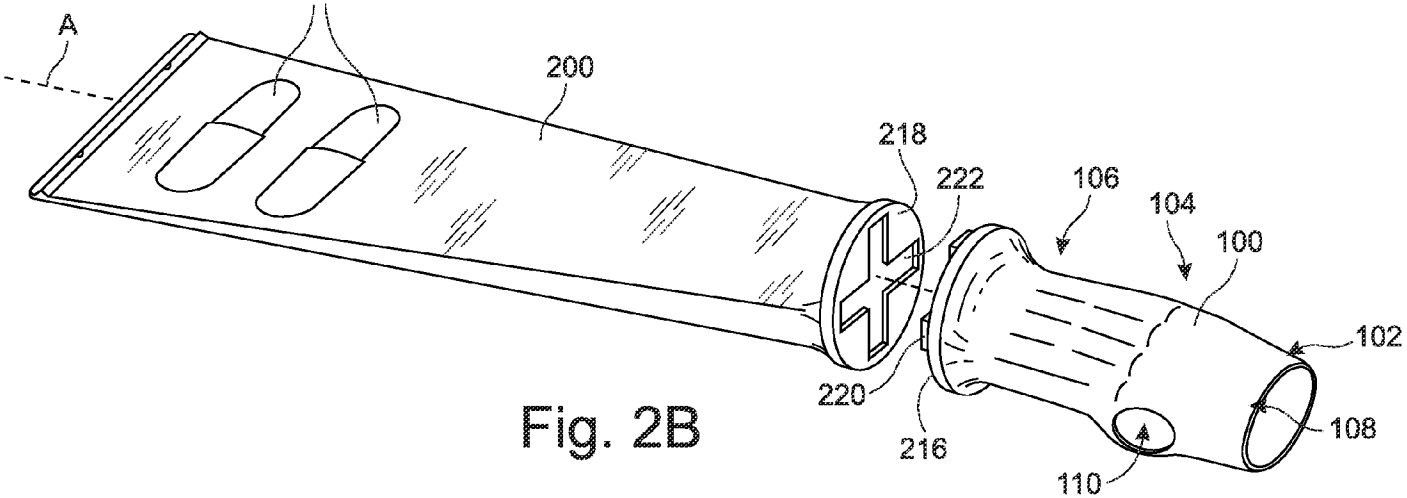
FIG. 2B is an exploded view of the embodiment of FIG. 2A.
Figure 4A:
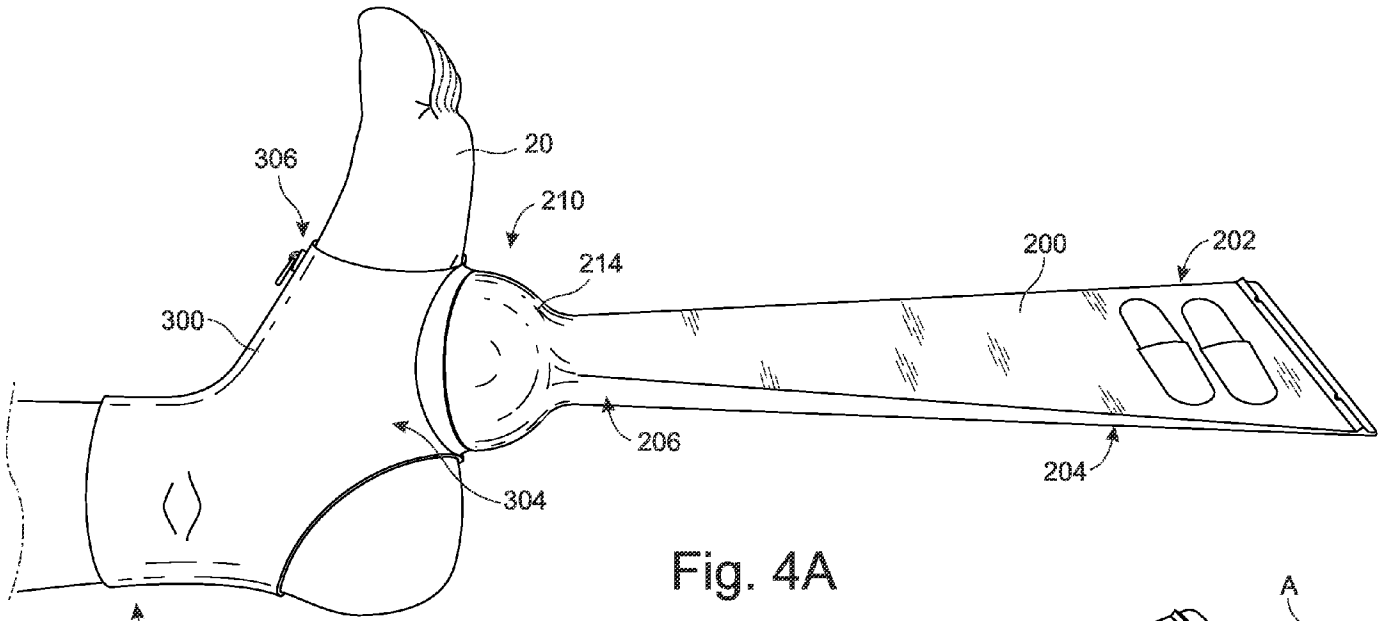
FIG. 4A is a perspective view of another embodiment of the present invention in which the resistance member is rotatably attached to a foot fitting member.
Figure 4B:
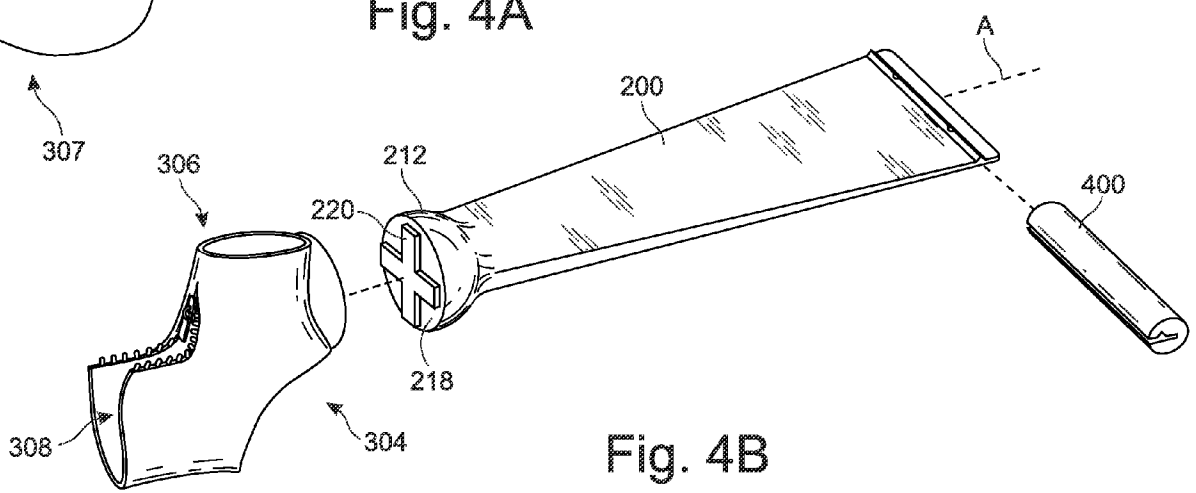
FIG. 4B is an exploded view of the embodiment of FIG. 4A.

The weight of the resistance member 200 can also be changed without having to change the resistance member 200 itself. For example, the resistance member 200 may be configured so that external weights 400 can be attached to the resistance member 200. For example, the resistance member 200 may have one or more pockets 402. Alternatively, or in addition to, the fitting member 100 or 300 may have a one or more pockets 404. In these embodiments, pockets 402 and 404 are illustrated in FIGS. 1A, 2A, and 4A as comprising two overlapping pouches, but Applicant contemplates other configurations, including pockets with snaps or zippers, or the like. The purpose is the same, to allow for the placing and securing of weights of given locations to affect resistance felt during an exercise.

In some embodiments, alternatively or in addition to, any pockets 402, 404, the fitting member 100 or 300 or the resistance member 200 may contain a fastening means 240 to secure a weight 400. For example, the fastening means 240 may be a hook-and-loop fastener, snap buttons, hooks, zippers, tongue and groove, rails, magnets, and the like.

In the preferred embodiment, a modified tongue and groove can be used in which the tongue is bent and the groove is a reciprocal bent slot. In the tongue and groove embodiments and other embodiments in which the weight 400 slides into place, the weight 400 may further comprise a stop 406 to prevent the weight 400 from falling off the fitting member 100 or 300 or the resistance member 200. The stop 406 may be a secondary fastener like any of the fastening means recited above. Alternatively, the stop 406 may be a protrusion, detent, and the like to retain the weight on the resistance member 200 during an exercise, but to allow the weight to be easily removed or exchanged with other weights between exercises.

The weights 400 may come in a variety of weights and sizes. This also permits the user to increase the weights 400 to increase the intensity of the exercise. In some embodiments, one weight 400 may be placed on each exercise device. In other embodiments, some weights 400 may be double in length and configured to attach to both the left and right hand exercise devices at the same time or to attach to both the left and right foot exercise devices at the same time (not shown). Using double length weights 400 in this way, the user can perform exercises in which he or she must move his or her hands or feet synchronously, such as moving them up-and-down in unison thereby achieving yet further different exercises.

Figure 9:
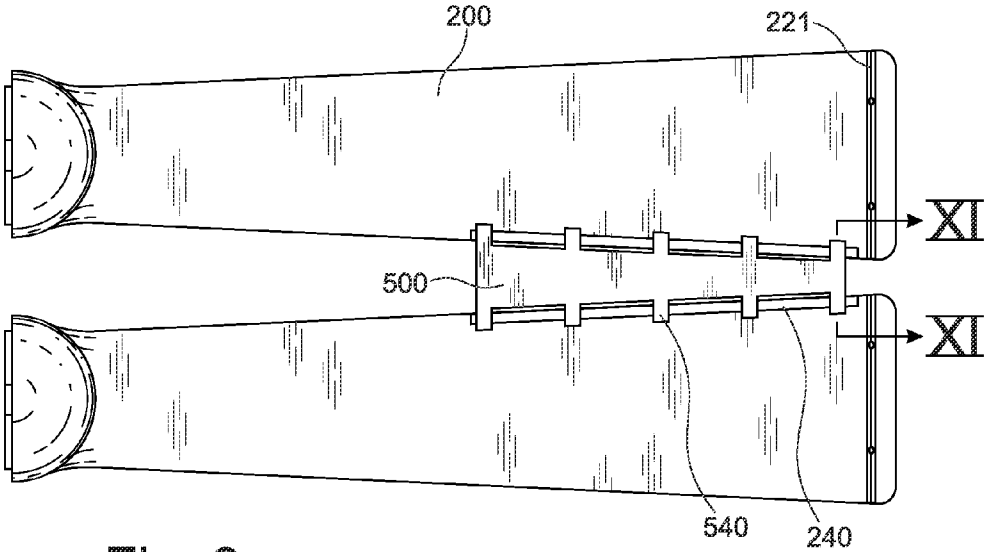
FIG. 9 is a top plan view of one embodiment of the present invention that uses an attachment bridge member so that the user can move the attached resistance members only in unison.
Figure 11:
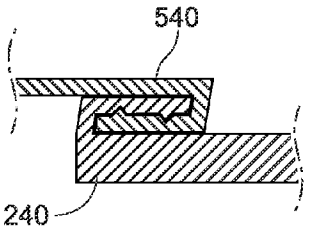
FIG. 11 is a cross sectional view of one example of an attachment bridge connector in keeping with the present invention as taken from the plane XI in FIG. 9.
Figure 12:
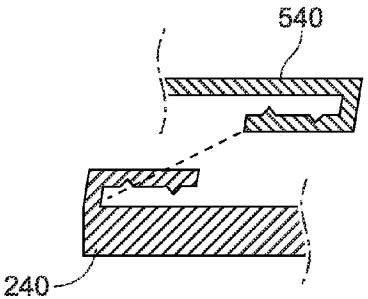
FIG. 12 is a cross sectional view of the attachment bridge connector of FIG. 11 but in a detached position.
Figure 10:
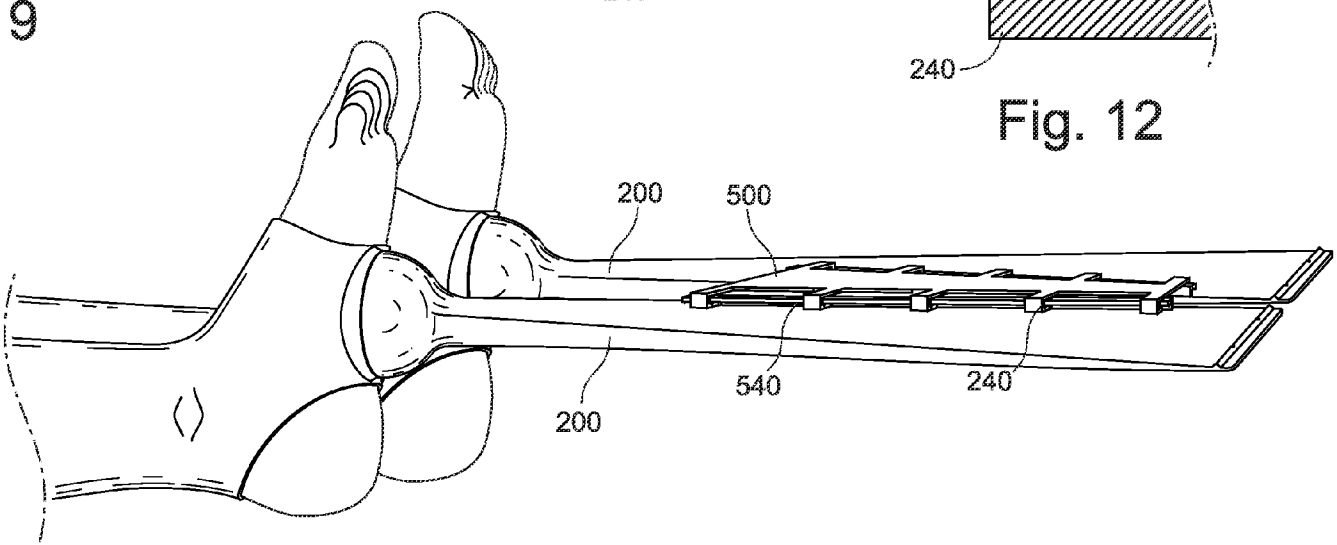
FIG. 10 is a perspective view of the embodiment of FIG. 9 in use.

Alternatively, the resistance members 200 may be attached using an attachment bridge 500, such as the one shown in FIGS. 9 and 10. In this embodiment, the resistance members could come with connector members 240 configured to receive one or more connector members 540 on the attachment bridge so that the two resistance members 200 may be easily formed into a temporarily locked pair of resistance members that can only move in unison. The connector members may have grooves and ridges, as shown in FIGS. 11 and 12, or other similar snap-like configurations so that the two resistance members 200 remain locked together during the exercise but readily detached from one another between exercises if desired.

Figure 6:
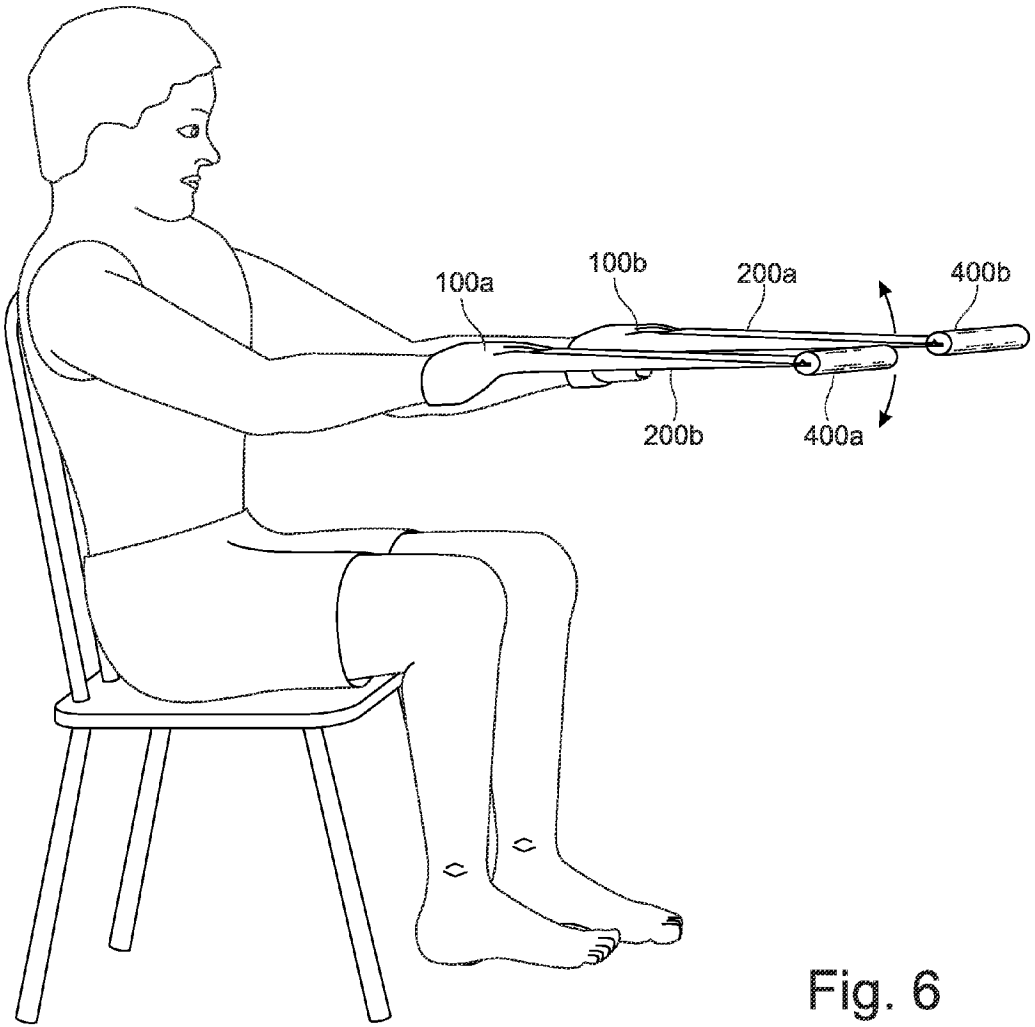
FIG. 6 is a perspective view of one exercise utilizing one embodiment of the present invention for the hands and moving the resistance members back and forth generally perpendicular to the floor, thereby exercising a given combination of muscle groups.
Figure 7:
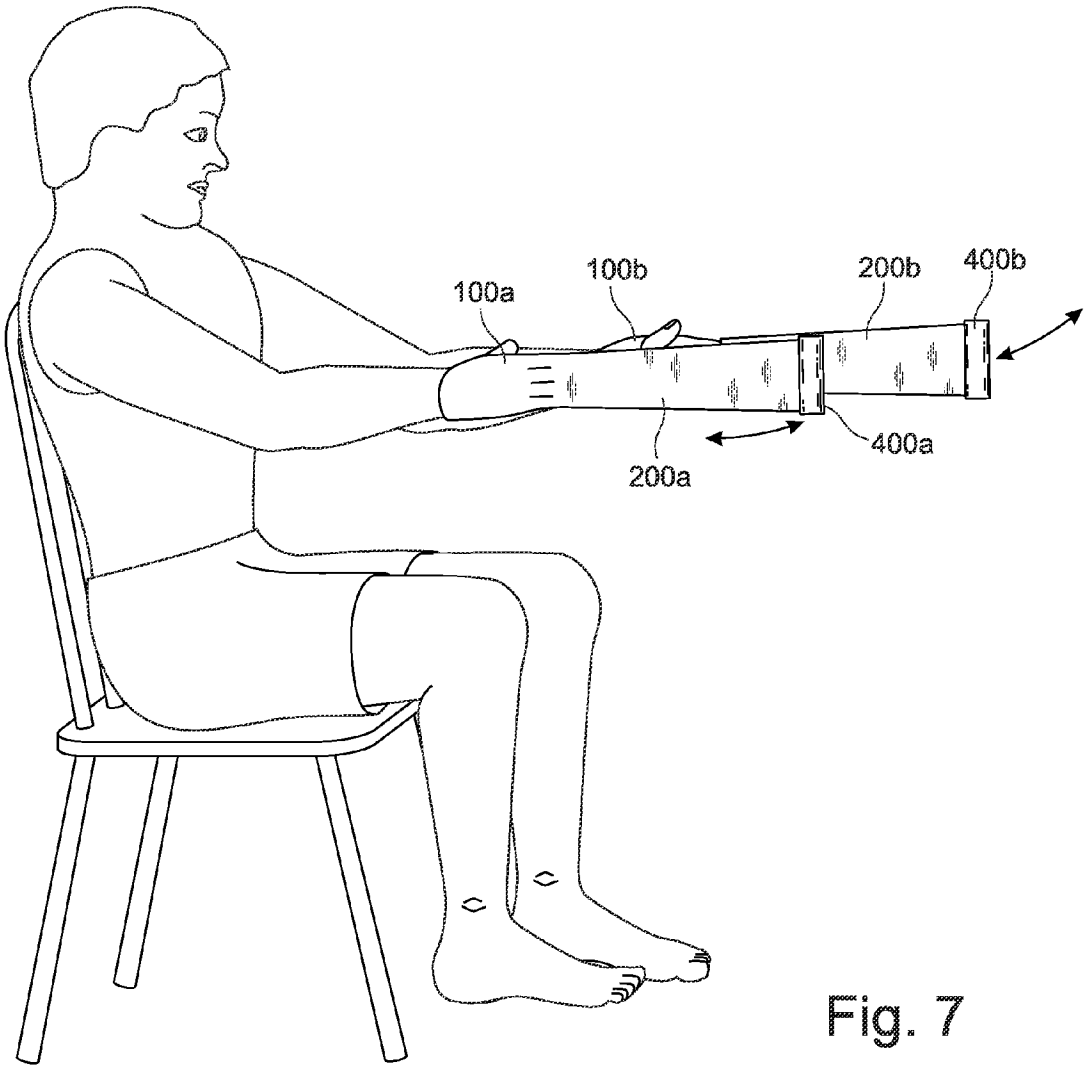
FIG. 7 is a perspective view of another exercise in which the user exercises different muscle groups than in FIG. 6 simply by rotating the user's arms and moving the resistance members back and forth generally parallel to the floor.
Figure 8:
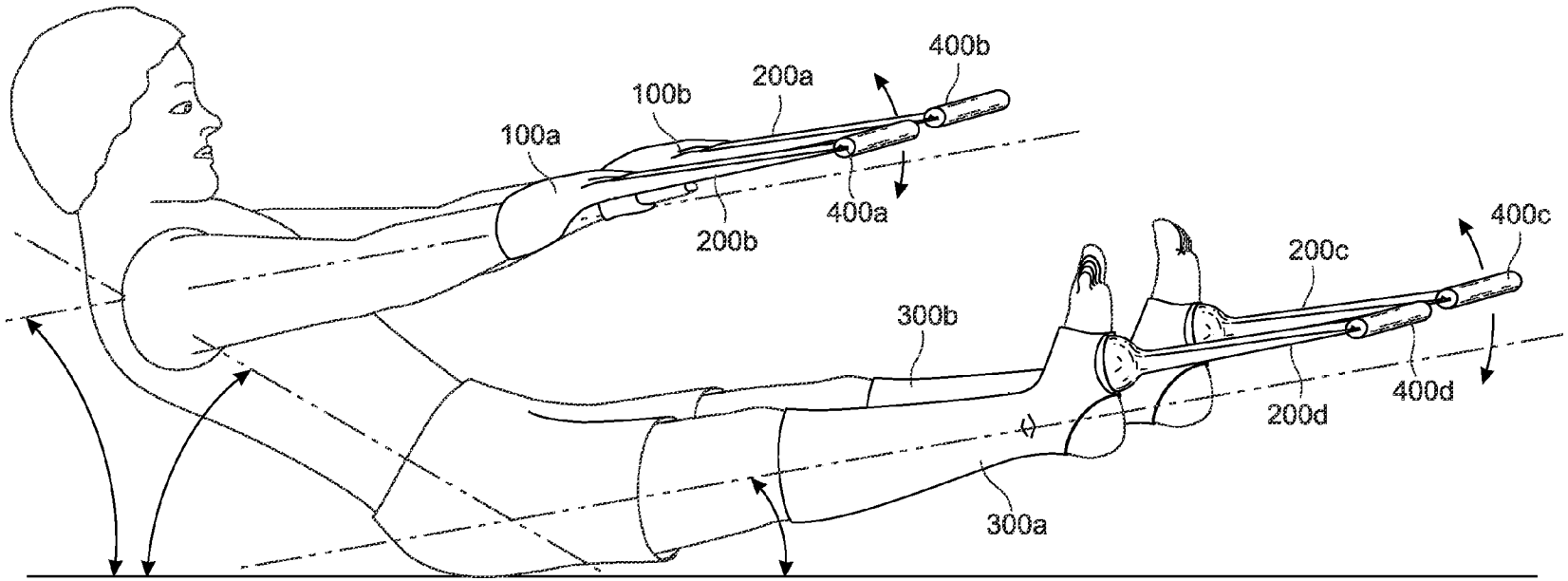
FIG. 8 is a perspective view of another set of exercises in keeping with one embodiment of the present invention by utilizing four such resistance members.

The exercise method then is to don the exercise device on the hands and/or the feet as shown in FIGS. 6 through 8, and wave one's straightened arms or legs up-and-down, or side-to-side in tiny quick strokes, repeatedly using the affected muscles to fight against the inertial and air resistance created by the short back and forth movements of the resistance members 200. In some embodiments, one may select among resistance members 200 of various dimensions (length, width, and thickness) and weights or resistance members 200 having holders to hold one or more weights 400.

That is, the user may put on his right hand (or arm) a first exercise device comprising a glove-like fitting member with a flipper-like resistance member extending beyond his finger tips. He may put on his left hand (or arm) a second exercise device comprising a similar glove-like fitting member and flipper-like resistance member. The user then moves his right and left arms back and forth in short linear movements such that the front and back faces of the flat faces of the resistance members push through the ambient air causing an opposing force that pushes back against these movements. The inertia of the resistance members also create an opposing force that pushes back against these movements. As a result, the user exercises the predetermined upper body and arm muscle groups.

The user can also exercise his legs in the same way, putting on right and left fins or flippers that extend out from the bottoms of the user's feet and moving his right and left legs back and forth in short linear movements. As a result, the ambient air interact with the broad front and back faces of the paddle or flipper-like resistance members to create opposing forces that push against these movements, and the inertia of the resistance members also create opposing forces that push back against these movements. As a result, the user exercises predetermined muscle groups in the lower body and legs.

The user may add weights to either sets of resistance members, either in pockets or other spaces provided or on the ends using friction-fit ridges as shown in FIGS. 1A through 4B, to enhance the given exercises, and the user may lock together pairs of resistance members using an attachment bridge so that the user must move two limbs in unison. As such, the user may perform exercises on many muscle groups in the back, chest, shoulders, abdominals, glutes, and legs in a small, highly portable package utilizing inertial and air resistance to provide resistance training without needing any bulky weights or support structures.

While the present invention has been described with regards to particular embodiments, it is recognized that additional variations of the present invention may be devised without departing from the inventive concept.

What is claimed is:

1. A method of performing an exercise, comprising:

a. donning a first exercise device on a right limb of a user, the exercise device comprising:

i. a fitting member configured to be fit around a portion of the user's right limb like a sock or a glove; and ii. a resistance member having a proximal end, a distal end, and a surface area in between the proximal end and distal end, the resistance member defining a first axis generally parallel to the user's right limb and rotatable relative to the fitting member about the axis by approximately 90°;

b. donning a second exercise device on a left limb of the user, the exercise device comprising:

i. a fitting member configured to be fit around a portion of the user's left limb like a sock or a glove; and ii. a resistance member having a proximal end, a distal end, and a surface area in between the proximal end and distal end, the resistance member defining a second axis generally parallel to the user's left limb;

c. adding one or more weights to the resistance member of at least one exercise device; and d. moving the right and left limbs back and forth in short linear movements, wherein the direction of the short linear movements is approximately perpendicular to said surface areas of the resistance members so that the air resistance effect of the short linear movements and/or the inertial effect of the changing the directions of the short linear movements works targeted muscle groups for the exercise.

2. The method of claim 1, further comprising donning four exercise devices, so that each hand and foot of the user has one exercise device attached thereto, each exercise device defining a separate axis approximately parallel to its respective limb.

3. The method of claim 1, further comprising attaching a bridge member to two exercise devices so that the user must move two limbs in unison.

4. A method of performing an exercise, comprising:

a. donning a first exercise device on a right limb of a user, the exercise device comprising:

i. a fitting member configured to be fit around a portion of the user's right limb like a sock or a glove; and ii. a resistance member having a proximal end, a distal end, and a surface area in between the proximal end and distal end, the resistance member defining a first axis generally parallel to the user's right limb;

b. donning a second exercise device on a left limb of the user, the exercise device comprising:

i. a fitting member configured to be fit around a portion of the user's left limb like a sock or a glove; and ii. a resistance member having a proximal end, a distal end, and a surface area in between the proximal end and distal end, the resistance member defining a second axis generally parallel to the user's left limb;

c. moving the right and left limbs back and forth in short linear movements, wherein the direction of the short linear movements is approximately perpendicular to said surface areas of the resistance members so that the air resistance effect of the short linear movements and/or the inertial effect of the changing the directions of the short linear movements works targeted muscle groups for the exercise.

5. The method of claim 4, further comprising rotating the resistance member relative to the fitting member about the axis by approximately 90°.

6. The method of claim 4, further comprising donning four exercise devices, so that each hand and foot of the user has one exercise device attached thereto, each exercise device defining a separate axis approximately parallel to its respective limb.

7. The method of claim 6, further comprising:

a. assuming a recumbent position; and b. moving each of the four limbs back and forth in short linear movements in a direction approximately perpendicular to the surface areas of the respective exercise device.

8. The method of claim 4, further comprising a. rotating the resistance member of at least one exercise device by approximately 90° about its axis; and b. moving the rotated exercise device in short linear movements in a direction approximately perpendicular to the surface areas of the rotated exercise device.

9. The method of claim 4, further comprising rotating the resistance member of at least one exercise device by approximately 45° about its axis to effectuate an exercise different than that which is available at approximately 0° or 90°.

10. The method of claim 4, further comprising simultaneously moving the resistance members of all four exercise devices back and forth in short linear movements in a direction generally perpendicular to their respective surface areas.

11. The method of claim 4, further comprising adding one or more weights to the resistance member of at least one exercise device.

12. The method of claim 4 further comprises attaching a bridge member to two exercise devices so that the user must move two limbs in unison.

* * * * *